US005432960A

United States Patent [19]

Kraut

[11] Patent Number: 5,432,960

[45] Date of Patent: Jul. 18, 1995

[54] HELMET MIRROR ATTACHMENT

[76] Inventor: Peter A. Kraut, 2616 Nicholas St., Simi Valley, Calif. 93065

[21] Appl. No.: 215,096

[22] Filed: Mar. 21, 1994

[51] Int. Cl.[6] ..... A42B 1/24

[52] U.S. Cl. ..... 2/422; 2/DIG. 8; 359/879

[58] Field of Search ..... 2/410, 411, 422, 424, 2/425, 209.13, 205, DIG. 8; 359/841, 844, 872, 876, 879, 880; 248/480, 476

[56] References Cited

U.S. PATENT DOCUMENTS

| | | | |
|---|---|---|---|
| 3,804,495 | 4/1974 | Rayow et al. | 2/422 |
| 3,978,526 | 9/1976 | Mitchell et al. | 2/422 |
| 4,651,357 | 3/1987 | Gershoni | 2/422 |
| 4,722,101 | 2/1988 | Blower | 2/425 |
| 5,076,701 | 12/1991 | Greenlaw | 359/879 |

FOREIGN PATENT DOCUMENTS

| | | | |
|---|---|---|---|
| 213890 | 3/1987 | European Pat. Off. | 2/410 |
| 2409021 | 7/1979 | France | 2/422 |
| 2631789 | 12/1989 | France | 2/424 |
| 2610245 | 9/1976 | Germany | 2/DIG. 8 |

*Primary Examiner*—Clifford D. Crowder
*Assistant Examiner*—Michael Neas

[57] ABSTRACT

An attachment for a protective visored helmet worn by riders of motorcycles, bicycles or the like comprising a first, curved, tapered, aerodynamic plastic housing adapted to be secured to the side of such helmet below the visor thereof, a slightly contoured plastic mirror mounted in a second complementary plastic housing connected to the upper surface of said first housing, and means to adjust the horizontal relationship of the two housings and the vertical angulation of such housings with respect to the helmet to which the first housing is secured. Such attachments are normally used in pairs, i.e. with one being positioned on each side of the helmet.

2 Claims, 2 Drawing Sheets

HELMET MIRROR ATTACHMENT

BACKGROUND OF THE INVENTION

1. Field of the Invention

The present invention relates to attachments for vehicle helmets and more particularly pertains to such attachments which provide rear view mirrors for such helmets.

2. Description of the Prior Art

The use of rear view mirrors for vehicle helmets is known in the prior art. More specifically, such devices heretofore devised and utilized for the purpose of providing rear vision for the riders of motorcycles or the like are known to consist basically of familiar, expected and obvious structural configurations, notwithstanding the myriad of designs encompassed by the crowded prior art which have been developed for the fulfillment of countless objectives and requirements. Generally such devices have either been cumbersome and the cause of wind resistance or have lacked easy adjustment features. Typical of known devices of this type are those shown in U.S. Pat. No. Des. 284,462; 3,577,561; 3,804,495; and 4,651,357.

In this respect, the helmet mirror according to the present invention substantially departs from the conventional concepts and designs of the prior art, and in so doing provides an apparatus primarily developed for the purpose of providing adjustable rear view vision for motorcycle or similar helmet wearers.

Therefore, it can be appreciated that there exists a continuing need for new and improved rear view mirrors which can be used on protective helmets. In this regard, the present invention substantially fulfills this need.

SUMMARY OF THE INVENTION

In view of the foregoing disadvantages inherent in the known types of rear view mirrors for helmets now present in the prior art, the present invention provides an improved helmet mirror construction wherein the same can be easily adjusted both vertically and horizontally. As such, the general purpose of the present invention, which will be described subsequently in greater detail, is to provide a new apparatus and method which has many of the advantages of the devices mentioned heretofore and many novel features that result in a helmet mirror attachment which is not anticipated, rendered obvious, suggested, or even implied by any of the prior art devices, either alone or in any combination thereof.

To attain this, the present invention generally relates to an attachment for a protective visored helmet worn by riders of motorcycles, bicycles or the like comprising a first, curved, tapered, aerodynamic plastic housing adapted to be secured to the side of such helmet below the visor thereof, a slightly contoured plastic mirror mounted in a second complementary plastic housing connected to the upper surface of said first housing, and means to adjust the horizontal relationship of the two housings and the vertical angulation of such housings with respect to the helmet to which the first housing is secured. Such attachments are normally used in pairs, i.e. with one being positioned on each side of the helmet.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new helmet mirror attachment which has many of the advantages of the devices mentioned heretofore and many novel features that result in a helmet mirror attachment which is not anticipated, rendered obvious, suggested, or even implied by any of the prior art devices, either alone or in any combination thereof.

It is another object of the present invention to provide a new and improved helmet mirror which may be easily and efficiently manufactured and marketed.

It is a further object of the present invention to provide a new and improved helmet mirror which is of a durable and reliable construction.

An even further object of the present invention is to provide a new and improved helmet mirror attachment which is susceptible of a low cost of manufacture with regard to both materials and labor, and which accordingly is then susceptible of low prices of sale to the consuming public, thereby making such attachments economically available to the buying public.

Still yet another object of the present invention is to provide a new and improved helmet mirror which provides in the apparatuses of the prior art some of the advantages thereof, while simultaneously overcoming some of the disadvantages normally associated therewith.

Still another object of the present invention is to provide a new and improved adjustable helmet mirror.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
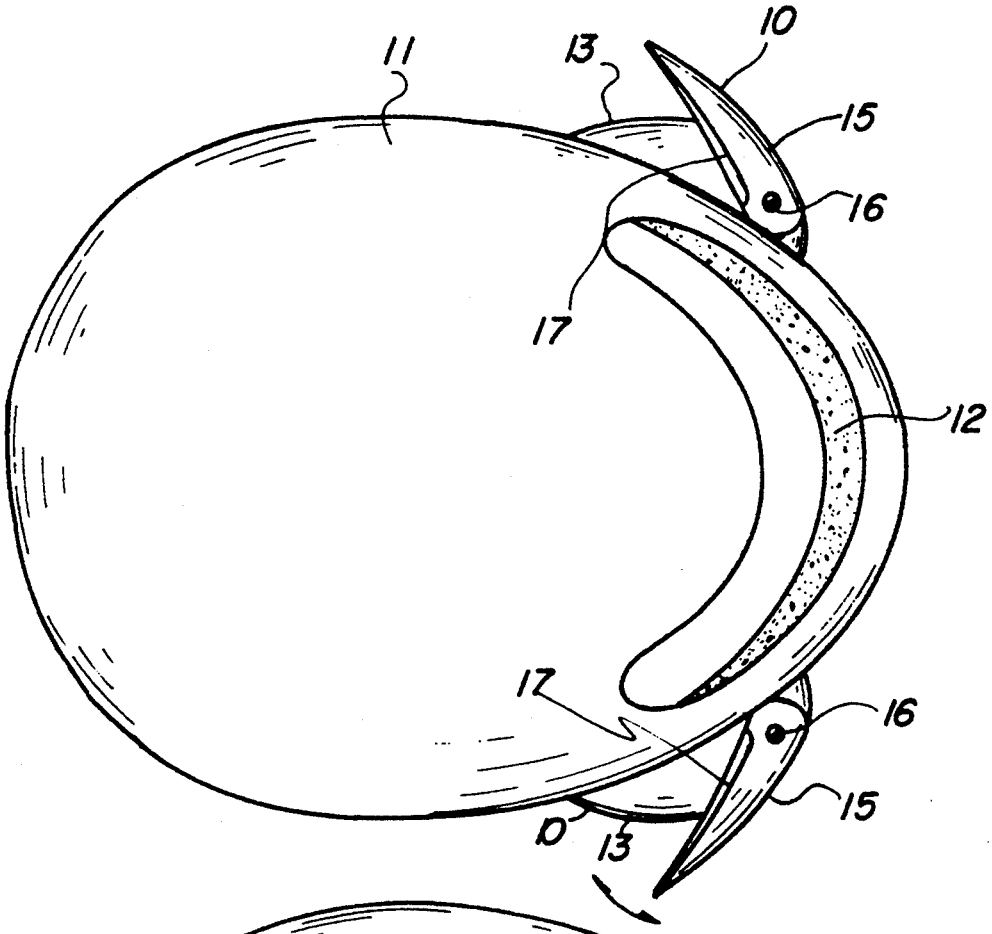
FIG. 1 is a top plan view of a visored motorcycle helmet with a pair of the attachments of the present invention affixed to each side thereof.
Figure 2:
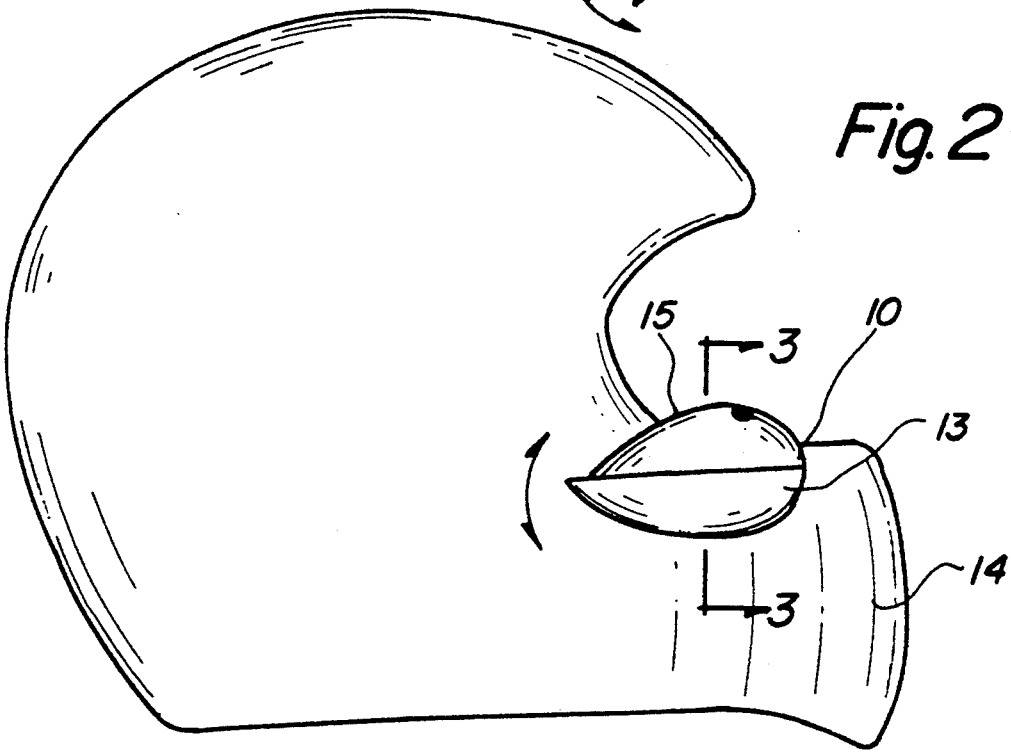
FIG. 2 is a side plan view of the helmet of FIG. 1 with the visor eliminated for sake of clarity.

With reference now to the drawings, and in particular to FIGS. 1 and 2 thereof, a new and improved helmet mirror attachment embodying the principles and concepts of the present invention and generally designated by the reference numeral 10 will be described.

More specifically, it will be noted that the attachment 10 of the present invention is shown mounted on each side of a conventional protective helmet 11. The helmet 11 is shown in FIG. 1 with a movable visor 12, such visor 12 being omitted in FIG. 2 for purposes of clarity. As shown in these drawings, the attachment 10 comprises an aerodynamic housing 13 secured to the chin guard 14 of helmet 11 so as not to interfere with the travel of moveable visor 12. Such housing 13 is curved to follow the jaw curve of the chin guard 14 and preferably is formed of a strong, high-impact plastic material. A second complementary curved housing 15 is mounted atop and in engagement with housing 13, being fastened thereto by an adjustable screw 16 (shown in more detail in the Figures described below). Securely mounted within such second housing 15 is a slightly contoured, essentially flat, plastic mirror 17. In closed position as shown in FIG. 2, the two housings form an aerodynamic unit. By adjustment of screw 16, the second upper housing can be pivoted around such screw 16 to allow the mirror 17 to be moved out into operative position as shown in FIG. 1.

Figure 3:
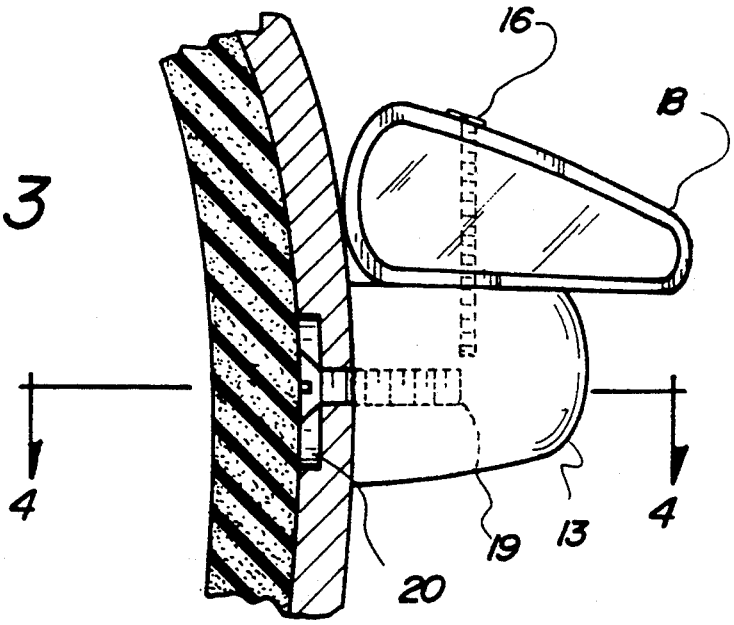
FIG. 3 is a sectional view on line 3—3 of FIG. 2.
Figure 4:
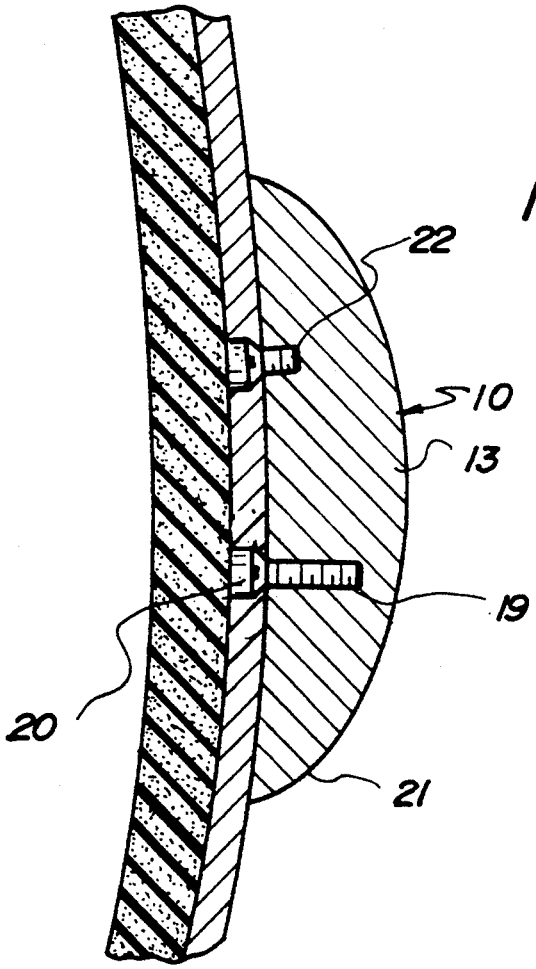
FIG. 4 is a sectional view on line 4—4 of FIG. 3.

FIGS. 3 and 4 are detailed views of attachment 10 showing the horizontal and vertical adjustments therefor. In FIG. 3, the horizontal adjustment screw 16 is shown. By loosening screw 16, the upper housing 15 can be pivoted around such screw 16 to permit the trailing or rear end 18 of housing 15 to swing out to any desired angle for proper rear vision in the associated mirror 17. Also shown in this side view is the vertical adjusting screw 19. The portion of screw 19 within housing 13 is fixed with respect to such housing 13 while the head portion of screw 19 is positioned within a long vertical slot 20 in the wall of helmet 11. By loosening screw 19 and moving it up within slot 20, the rear or trailing end 21 will be moved up causing the upper housing 15 to move with it and thereby tilting mirror 15 angularly upward to adjust such mirror 15 to the user's satisfaction. FIG. 4 illustrates the securing screw 22 which extends through the wall of helmet 11 and fastens the attachment 10 to such helmet 11.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A mirror attachment in combination with a protective helmet which comprises: a first, curved, tapered, aerodynamic plastic housing; a second complementary housing positioned atop and secured to said first housing; a slightly contoured mirror securely mounted within said second housing; means to permit said second housing and associated mirror to pivot horizontally outward from said first housing; means to permit said first housing and the second housing secured thereto to angularly pivot in a vertical direction; and means to fasten said first housing to the protective helmet; said means to permit said second housing to pivot horizontally outward from said first housing comprises an adjustable screw freely extending through said second housing and threadably engaged in said first housing.

2. A mirror attachment in combination with a protective helmet which comprises: a first, curved, tapered, aerodynamic plastic housing; a second complementary housing positioned atop and secured to said first housing; a slightly contoured mirror securely mounted within said second housing; means to permit said second housing and associated mirror to pivot horizontally outward from said first housing; means to permit said first housing and the second housing secured thereto to angularly pivot in a vertical direction; and means to fasten said first housing to the protective helmet; said means permits said second housing to pivot horizontally outward from said first housing comprises an adjustable screw freely extending through said second housing and threadably engaged in said first housing; said means to permit said first housing and the second housing secured thereto to angularly pivot in a vertical direction comprises a vertical slot extending through the wall of the protective helmet adjacent the rear, trailing end of said first housing; an adjusting screw extending through said slot and slidable therein; and a fixed threaded receptacle for said adjusting screw in the rear, trailing end of said first housing whereby moving said adjusting screw within said slot will cause angular vertical movement of said rear trailing end of said first housing.

* * * * *